US006732711B2

(12) United States Patent
Yanagii

(10) Patent No.: US 6,732,711 B2
(45) Date of Patent: May 11, 2004

(54) FUEL DISTRIBUTION PIPE IN FUEL INJECTION APPARATUS

(75) Inventor: Yoichi Yanagii, Kawasaki (JP)

(73) Assignee: Keihin Corporation, Tokyo (JP)

( * ) Notice: Subject to any disclaimer, the term of this patent is extended or adjusted under 35 U.S.C. 154(b) by 2 days.

(21) Appl. No.: 10/462,416

(22) Filed: Jun. 16, 2003

(65) Prior Publication Data

US 2004/0050364 A1 Mar. 18, 2004

(30) Foreign Application Priority Data

Sep. 18, 2002 (JP) ..... 2002-272032

(51) Int. Cl.[7] ..... F02M 55/02
(52) U.S. Cl. ..... 123/469; 123/456
(58) Field of Search ..... 123/468, 469, 123/470, 472, 456

(56) References Cited

U.S. PATENT DOCUMENTS 4,570,601 A * 2/1986 Ito et al. ..... 123/468
4,660,531 A * 4/1987 Lauterbach et al. ..... 123/456
5,056,489 A * 10/1991 Lorraine ..... 123/468
5,735,247 A * 4/1998 Tsuzuki et al. ..... 123/470
5,868,111 A * 2/1999 Augustin ..... 123/198 D
6,227,169 B1 * 5/2001 Sato et al. ..... 123/456
6,341,595 B1 * 1/2002 Scollard et al. ..... 123/456
6,626,152 B1 * 9/2003 Deangelis et al. ..... 123/468

* cited by examiner

*Primary Examiner*—Carl S. Miller
(74) *Attorney, Agent, or Firm*—R. Neil Sudol; Henry D. Coleman; William J. Sapone

(57) ABSTRACT

To reduce the number of the fuel distribution pipes and fuel joints to make the cost for them inexpensive, a fuel distribution pipe is provided with a fuel distribution passage with one end being opened by a fuel introduction hole, a plurality of injection valve insertion holes positioned apart from a longitudinal axial line of the fuel distribution passage toward one side by a predetermined amount, having longitudinal axial lines thereof crossing orthogonally to the longitudinal axial line, and having a leading end open toward one side a plurality of mounting bosses formed orthogonally to a cross section including the longitudinal axial lines and, and each having an upper end surfaces and a lower end surfaces uniformly protruding upward and, downward a predetermined amount from the longitudinal axial line, and mounting holes provided in the mounting bosses apart from the longitudinal axial line toward one side by a predetermined amount, at least two fuel distribution pipes being prepared, the fuel introduction holes being arranged to be opposed to each other, and the longitudinal axial line being concentrically arranged, whereby the injection valve insertion holes and the mounting holes are arranged in the same direction at the same position.

1 Claim, 8 Drawing Sheets

FUEL DISTRIBUTION PIPE IN FUEL INJECTION APPARATUS

BACKGROUND OF THE INVENTION

1. Field of the Invention

The present invention relates to a fuel injection apparatus which increases a pressure of fuel within a fuel tank by a fuel pump, and injects to supply the fuel having the increased pressure to an engine via a fuel injection valve, and more particularly to a fuel distribution pipe to which the fuel having the increased pressure is supplied and a plurality of fuel injection valves are attached.

2. Description of Conventional Art

The conventional fuel distribution pipe to which a plurality of fuel injection valves are attached is shown in FIGS. 8, 9 and 10.

FIG. 8 is a plan view of the lower side of the fuel distribution pipe, FIG. 9 is a cross sectional view along a line L—L in FIG. 8, and FIG. 10 is a cross sectional view showing a state in which the fuel injection valves are attached in a line M—M and the fuel distribution pipe is fixed and arranged to a fixing portion.

The present conventional art relates to a fuel distribution pipe for a 4-cylinder engine which is provided with four fuel injection valves and has four fuel distribution pipes to which the respective fuel injection valves are attached.

In FIGS. 8 and 9, first to fourth fuel distribution pipes are arranged from the left to the right.

A first fuel distribution pipe 20 is structured such that an injection valve insertion hole 20A is opened upward in FIG. 9, a fuel introduction hole 20B is horizontally provided leftward from the right end, and the left end of the fuel introduction hole 20B is communicated with the injection valve insertion hole 20A.

Further, reference symbol 20C denotes a mounting hole. The mounting hole 20C is provided in parallel to the longitudinal axial line of the injection valve insertion hole 20A, and is formed in one side of the injection valve insertion hole 20A. (The mounting hole 20C is shown in FIG. 8.)

In this case, in the first fuel distribution pipe 20, a hole 20D open to the left end is not communicated with the injection valve insertion hole 20A.

A second fuel distribution pipe 21 is structured such that an injection valve insertion hole 21A is opened upward, a first fuel introduction hole 21B is horizontally provided leftward from the right end, a second fuel introduction hole 21C is horizontally provided rightward from the left end, and the first and second fuel introduction holes 21B and 21C are both communicated with the injection valve insertion hole 21A.

Further, reference symbol 21D denotes a mounting hole. The mounting hole 21D is provided in the same direction as that of the injection valve insertion hole 21A, and is formed in one side of the injection valve insertion hole 21A.

The third fuel distribution pipe is the same as the second fuel distribution pipe, however, a description will be given by using new reference symbol for making the description easy.

A third fuel distribution pipe 22 is structured such that an injection valve insertion hole 22A is opened upward, a first fuel introduction hole 22B is horizontally provided leftward from the right end, a second fuel introduction hole 22C is horizontally provided rightward from the left end, and the first and second fuel introduction holes 22B and 22C are both communicated with the injection valve insertion hole 22A.

Further, reference symbol 22D denotes a mounting hole. The mounting hole 22D is provided in the same direction as that of the injection valve insertion hole 22A, and is formed in one side of the injection valve insertion hole 22A.

A fourth fuel distribution pipe 23 is structured such that an injection valve insertion hole 23A is opened upward, a fuel introduction hole 23B is horizontally provided rightward from the left end, and the right end of the fuel introduction hole 23B is communicated with the injection valve insertion hole 23A. Further, reference symbol 23C denotes a mounting hole. The mounting hole 23C is provided in parallel to the longitudinal axial line of the injection valve insertion hole 23A, and is formed in one side of the injection valve insertion hole 23A.

In this case, in the fourth fuel distribution pipe 23, a hole 23D open to the right end is not communicated with the injection valve insertion hole 23A.

In accordance with the fuel distribution pipe mentioned above, the fuel introduction hole 20B of the first fuel distribution pipe 20 and the second fuel introduction hole 21C of the second fuel distribution pipe 21 are arranged so as to be opposed to each other, and they are connected by a first fuel joint 24 constituted by a straight pipe.

Further, the first fuel introduction hole 21B of the second fuel distribution pipe 21 and the second fuel introduction hole 22C of the third fuel distribution pipe 22 are arranged so as to be opposed to each other, and they are connected by a second fuel joint 25 constituted by a T-shaped pipe.

Further, the first fuel introduction hole 22B of the third fuel distribution pipe 22 and the fuel introduction hole 23B of the fourth fuel distribution pipe 23 are arranged so as to be opposed to each other, and they are connected by a third fuel joint 26 constituted by a straight pipe.

Further, a rear end portion of a fuel injection valve J (shown in FIG. 10) is inserted and arranged within each of the injection valve insertion holes 20A, 21A, 22A and 23A of the respective fuel distribution pipes 20, 21, 22 and 23, and a leading end portion of each of the fuel injection valves J is inserted and arranged within a guide hole 26B of a throttle body 26 in which an intake passage 26A is provided.

Then, in such a state, the respective fuel distribution pipes 20, 21, 22 and 23 are fixed to the throttle body 26 corresponding to a fixing portion by inserting a screw member 27 within the mounting holes 20C, 21D, 22D and 23C, and screwing the screw member 27 with the throttle body 26.

In the manner mentioned above, each of the fuel distribution pipes 20, 21, 22 and 23 is fixed to the throttle body 26, and fuel is supplied to each of the fuel distribution pipes in the following manner.

A part of the fuel supplied to the second fuel joint 25 is introduced to the first fuel introduction hole 21B of the second fuel distribution pipe 21, and this fuel is supplied toward the fuel injection valve J attached to the injection valve insertion hole 21A of the second fuel distribution pipe 21.

Further, the fuel within the first fuel introduction hole 21B of the second fuel distribution pipe 21 is introduced to the fuel introduction hole 20B of the first fuel distribution pipe 20 via the second fuel introduction hole 21C and the first fuel joint 24, and this fuel is supplied toward the fuel injection valve J screwed with the injection valve insertion hole 20A of the first fuel distribution pipe 20.

On the other hand, another part of the fuel supplied to the second fuel joint 25 is introduced to the second fuel introduction hole 22C of the third fuel distribution pipe 22, and this fuel is supplied toward the fuel injection valve J attached to the injection valve insertion hole 22A of the third fuel distribution pipe 22.

Further, the fuel within the second fuel introduction hole 22C of the third fuel distribution pipe 22 is introduced to the fuel introduction hole 23B of the fourth fuel distribution pipe 23 via the first fuel introduction hole 22A and the third fuel joint 26, and this fuel is supplied toward the fuel injection valve J screwed with the injection valve insertion hole 23A of the fourth fuel distribution pipe 23.

In accordance with the fuel distribution pipe in the conventional fuel injection apparatus mentioned above, three fuel distribution pipes are required. That is, there are provided the first fuel distribution pipe 20, the second fuel distribution pipe 21 and the fourth fuel distribution pipe 23.

The first fuel distribution pipe 20 and the fourth fuel distribution pipe 23 can not be for common use, since the openings of the fuel introduction holes are provided at reverse positions. On the other hand, the second fuel distribution pipe 21 and the third fuel distribution pipe 22 can be for common use.

In accordance with the structure mentioned above, the number of the parts is increased. Accordingly, particularly in the case that the fuel distribution pipe is formed by a synthetic resin material, the number of the metal molds and the number of the cores are increased, so that it is impossible to reduce a manufacturing cost.

Further, three pipes comprising the first fuel joint 24, the second fuel joint 25 and the third fuel joint 26 are required as the pipes for connecting the respective fuel distribution pipes to form a flow path, and an O-ring for inhibiting the fuel from leaking from the fuel introduction hole is required in the outer periphery of each of the fuel joints, so that the number of the parts and the number of man-hour for assembling are increased, and this structure is not preferable.

Particularly, in the O-ring portion arranged in the outer periphery of the fuel joint, it is necessary to carry out an air tightness test so as to check the fuel leakage, whereby an increase of the number of man-hour for test is caused.

SUMMARY OF THE INVENTION

A fuel distribution pipe in a fuel injection apparatus in accordance with the present invention is made by taking the problems mentioned above into consideration, and an object of the present invention is to provide a fuel distribution pipe having a plurality of fuel injection valves attached thereto, in which the number of parts in the fuel distribution pipe and a fuel joint and the number of man-hour for assembling them are reduced, whereby an inexpensive fuel distribution pipe is provided.

In accordance with the present invention, in order to achieve the object mentioned above, there is provided a fuel distribution pipe in a fuel injection apparatus, in which fuel having a pressure increased by a fuel pump is supplied to a fuel distribution passage and a plurality of fuel injection valves for injecting and supplying the fuel within the fuel distribution passage toward an engine are provided, wherein the fuel distribution pipe comprises:

a fuel distribution passage formed along the longitudinal direction with one end being opened by a fuel introduction hole and another end being closed;

a plurality of injection valve insertion holes positioned apart from the longitudinal axial line A—A of the fuel distribution passage toward one side by a predetermined amount, having the longitudinal axial lines D—D of the injection valve insertion holes crossing orthogonally to the longitudinal axial line A—A, having a leading end open toward one side B and a rear end communicated with the fuel distribution passage, and formed along the longitudinal axial line A—A with an interval E;

a plurality of mounting bosses formed orthogonally to a cross section including the longitudinal axial lines D—D of the injection valve insertion holes and the longitudinal axial line A—A of the fuel distribution passage, and each having an upper end surface and a lower end surface being formed so as to uniformly protrude upward and downward on the basis of the longitudinal axial line A—A of the fuel distribution passage; and mounting holes provided from the upper end surfaces of the respective mounting bosses toward the lower end surface, and provided apart from the longitudinal axial line of the fuel distribution passage toward one side B by a predetermined amount, wherein fuel introduction holes of the fuel distribution pipe are arranged so as to oppose to each other, the longitudinal axial lines of the respective fuel distribution pipes are concentrically arranged, the respective fuel injection valve insertion holes are arranged so as to open toward the same direction, the opposing fuel introduction holes are connected by a single fuel joint, rear end portions of the fuel injection valves are arranged so as to be inserted to the respective fuel injection valve insertion holes, and the fuel distribution pipe is screwed with and fixed to fixing portions by screw members inserted to the respective mounting holes.

In accordance with the fuel distribution pipe of the present invention, since the respective fuel introduction holes of two fuel distribution pipes are arranged so as to oppose to each other, it is possible to arrange a plurality of injection valve insertion holes formed in the respective fuel distribution pipes in the same direction and at the same position, whereby it is possible to attach the rear ends of a plurality of fuel injection valves in the same direction and at the same position.

Further, since the mounting holes formed in the respective fuel distribution pipes can be also arranged in the same direction and at the same position, it is possible to make the positions of the fixing portions corresponding to the mounting holes common.

Further, the fuel introduction pipe for supplying the fuel to the fuel distribution pipe and the connection pipe for communicating the fuel introduction holes of the respective fuel distribution pipes can be achieved by a single fuel joint.

DESCRIPTION OF THE PREFERRED EMBODIMENT

A description will be given below of one embodiment of a fuel distribution pipe in a fuel injection apparatus in accordance with the present invention with reference to the accompanying drawings.

Figure 1:
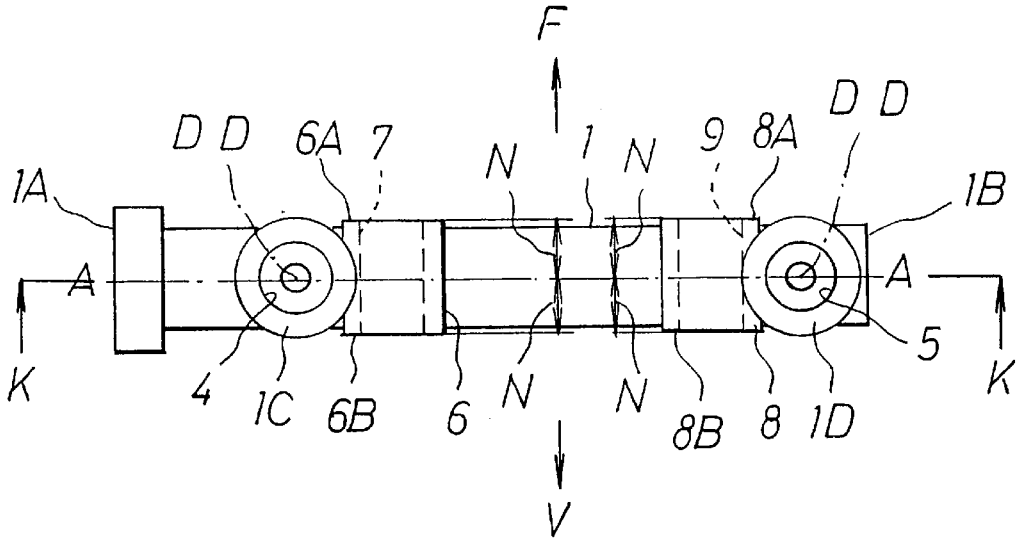
FIG. 1 is a side view showing one embodiment of a fuel distribution pipe in accordance with the present invention.
Figure 2:
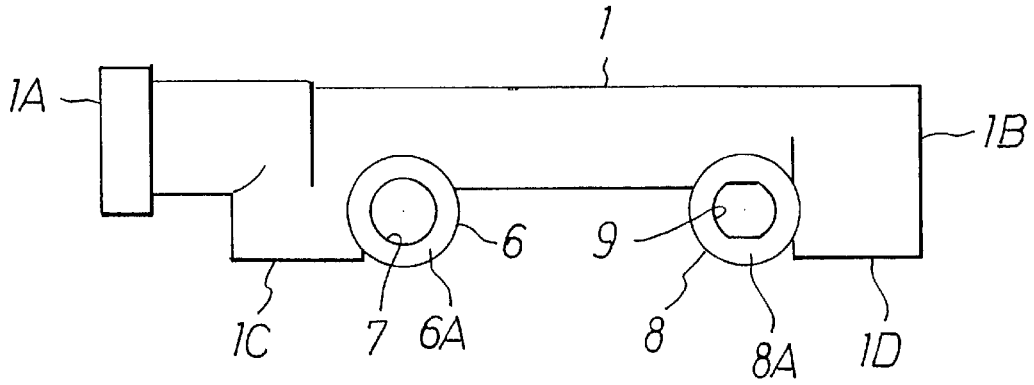
FIG. 2 is a plan view of an upper portion in FIG. 1.
Figure 3:
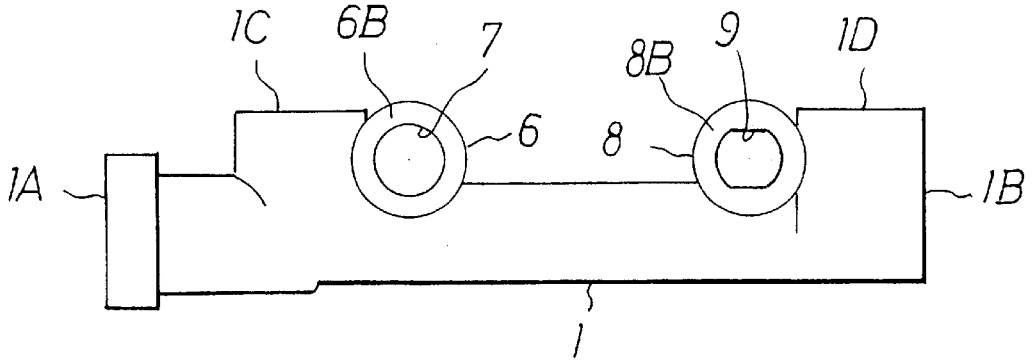
FIG. 3 is a plan view of a lower portion in FIG. 1.
Figure 4:
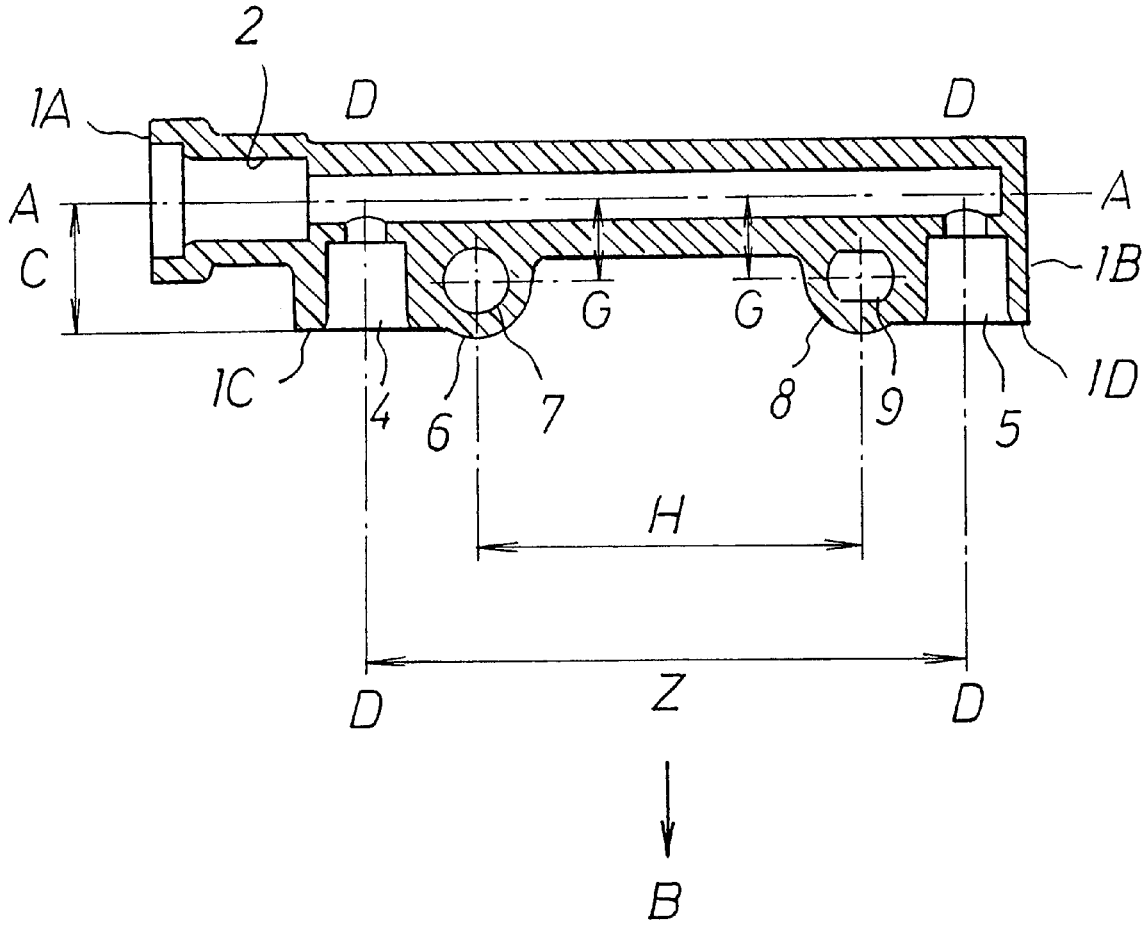
FIG. 4 is a transversal cross sectional view taken along a line K—K in FIG. 1.

FIG. 1 is a side view of a fuel distribution pipe, FIG. 2 is a plan view of an upper portion in FIG. 1, FIG. 3 is a plan view of a lower portion in FIG. 1, and FIG. 4 is a vertical cross sectional view taken along a line K—K in FIG. 1.

The present embodiment relates to a fuel distribution pipe provided with four fuel injection valves, in order to inject to supply fuel to each of intake pipes of a 4-cylinder engine.

Each of the fuel distribution pipe 1 is formed in the following manner.

Reference numeral 2 denotes a fuel introduction hole open to one end 1A (the left end) of the fuel distribution pipe 1. A fuel distribution passage 3 formed in closed end hole shape is continuously provided from a bottom portion of the fuel introduction hole 2 toward a direction of another end 1B (the right end) of the fuel distribution pipe 1.

The fuel introduction hole 2 and the fuel distribution passage 3 are concentrically formed along the longitude in axial line A—A of the fuel distribution pipe 1.

Reference numeral 4 denotes a first injection valve insertion hole formed in one side B with respect to the longitudinal axial line A—A of the fuel distribution pipe 1 so as to be open to a first injection valve support end surface 1C which is apart therefrom by a distance C. The longitudinal axial line D—D of the first injection valve insertion hole 4 crosses orthogonally to the longitudinal axial line A—A of the fuel distribution pipe 1.

Further, the rear end of the first injection valve insertion hole 4 is communicated with the fuel distribution passage 3. (In this case, a leading end of the first injection valve insertion hole 4 is open to the injection valve support end surface 1C as mentioned above so as to face to one side B.)

Reference numeral 5 denotes a second injection valve insertion hole formed in one side B with respect to the longitudinal axial line A—A of the fuel distribution pipe 1 so as to be open to a second injection valve support end surface 1D which is apart therefrom by the distance C and apart from the longitudinal axial line D—D of the first injection valve insertion hole 4 in the direction of another end 1B at an interval E. The longitudinal axial line D—D of the second injection valve insertion hole 5 also crosses orthogonally to the longitudinal axial line A—A of the fuel distribution pipe 1.

Further, the rear end of the second injection valve insertion hole 5 is also communicated with the fuel distribution passage 3.

In other words, the first injection valve support end surface 1C and the second injection valve support end surface 1D exist at the distance C in one side B with respect to the longitudinal axial line A—A of the fuel distribution pipe 1 and are formed with the interval E, the first injection valve insertion hole 4 is formed so as to be opened to the first injection valve support end surface 1C, and the second injection valve insertion hole 5 is formed so as to be opened to the second injection valve support end surface 1D. Accordingly, the first injection valve insertion hole 4 and the second injection valve insertion hole 5 are opened and arranged in the same direction and the same position along the longitudinal axial line A—A of the fuel distribution passage 3 at the interval E. This is well shown in FIGS. 1 and 4.

Reference numeral 6 denotes a first mounting boss formed orthogonally to a cross section (corresponding to a cross section in FIG. 4) including the longitudinal axial lines D—D of the injection valve insertion holes 4 and 5 and the longitudinal axial line A—A of the fuel distribution passage 3. An upper end surface 6A and a lower end surface 6B of the mounting boss are formed so as to be respectively protruded uniformly upward F and downward V from the longitudinal axial line A—A of the fuel distribution passage 3 by a distance N. Reference numeral 7 denotes a first mounting hole provided so as to penetrate from the upper end surface 6A of the first mounting boss 6 toward the lower end surface 6B. The first mounting hole 7 is provided in one side B with respect to the longitudinal axial line A—A of the fuel distribution pipe 1 so as to be apart by a distance G. (This is well shown in FIGS. 4 and 2.)

Reference numeral 8 denotes a second mounting boss formed orthogonally to the cross section (corresponding to the cross section in FIG. 4) including the longitudinal axial lines D—D of the injection valve insertion holes 4 and 5 and the longitudinal axial line A—A of the fuel distribution passage 3. An upper end surface 8A and a lower end surface 8B of the mounting boss are formed so as to be respectively protruded uniformly upward F and downward V from the longitudinal axial line A—A of the fuel distribution passage 3 by a distance N. Reference numeral 9 denotes a second mounting hole provided so as to penetrate from the upper end surface 8A of the second mounting boss 8 toward the lower end surface 8B. The second mounting hole 9 is formed in one side B with respect to the longitudinal axial line A—A of the fuel distribution pipe 1 so as to be apart by a distance G and apart from the axis of the first mounting hole 7 in the longitudinal direction by a distance H. (This is well shown in FIG. 4.)

As described above, each of the fuel distribution pipes 1 in accordance with the present embodiment is provided with the single fuel distribution passage 3, two injection valve insertion holes 4 and 5 and two mounting holes 7 and 9.

Then, the fuel injection apparatus is structured by being assembled in the following manner.

Figure 5:
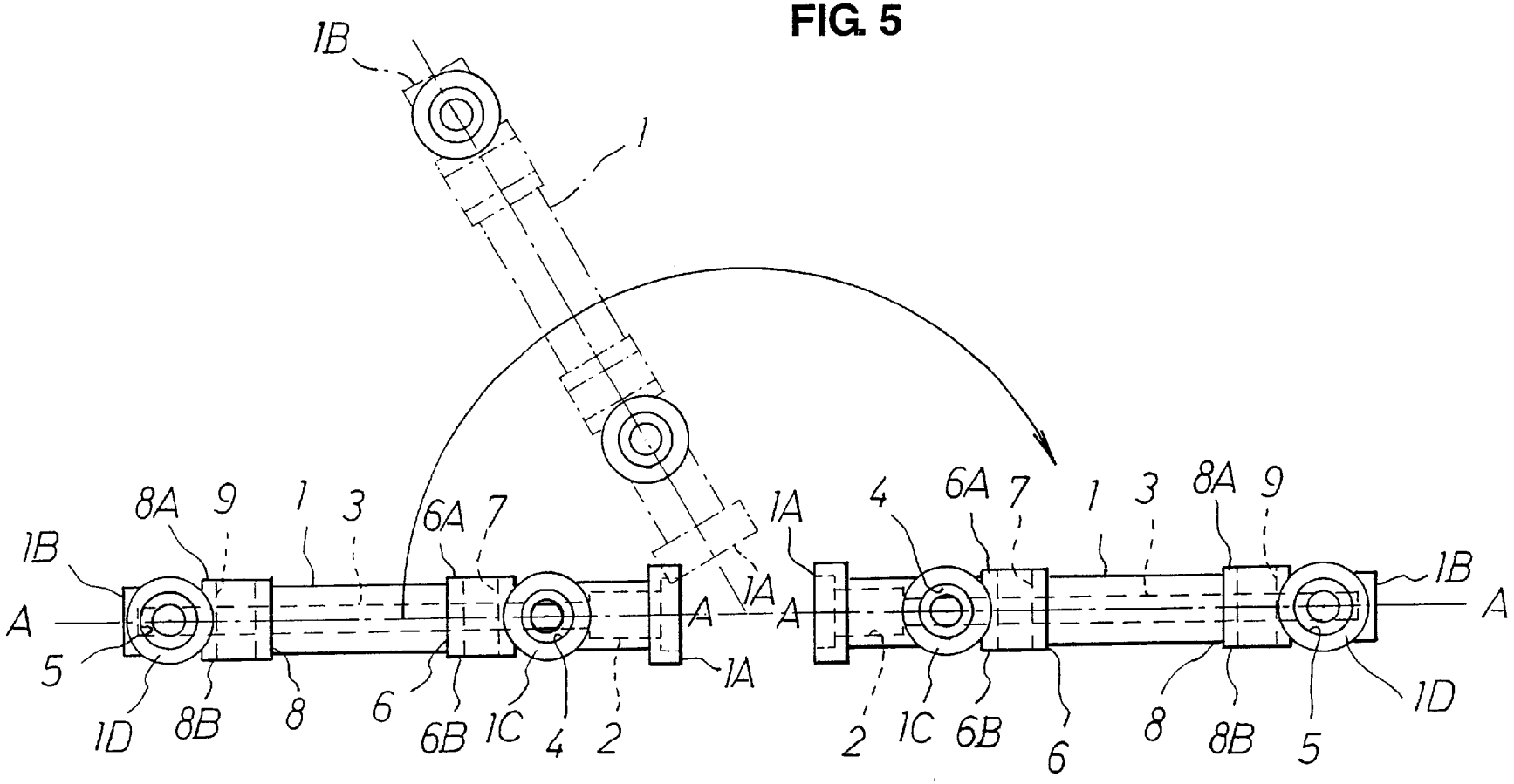
FIG. 5 is a side view corresponding to FIG. 1 showing a state in which the fuel distribution pipes are arranged.

First, two fuel distribution pipes 1 are prepared, and these fuel distribution pipes 1 and 1 are arranged as shown in FIG. 5.

That is, two fuel distribution pipes are arranged in the right and left sides. At this time, the fuel introduction holes 2 and 2 of the right and left fuel distribution pipes 1 and 1 are arranged so as to be opposed to each other, and the longitudinal axial lines A—A of the right and left fuel distribution passages 3 and 3 are concentrically arranged.

Further, the first and second injection valve insertion holes 4 and 5 of the left fuel distribution passage 1, and the first and second injection valve insertion holes 4 and 5 of the right fuel distribution passage 1 are arranged in the same direction.

In FIG. 5, the fuel injection valve insertion holes 4 and 5 are opened toward the front of the paper surface.

Further, the first and second mounting holes 7 and 9 of the left fuel distribution passage 1 are also arranged in the same direction. In FIG. 5, the mounting holes 7 and 9 are open in the vertical direction.

In order to arrange the fuel distribution passage in the manner mentioned above, two fuel distribution pipes are prepared, and the fuel distribution pipe in one side is arranged by rotating at 180 degrees as shown in FIG. 5. Accordingly, the fuel introduction holes 2 can be arranged so as to be opposed to each other, and the longitudinal axial lines A—A of the fuel distribution pipes 3 can be concentrically arranged. Further, all the injection valve insertion holes 4 and 5 can be arranged in the same direction apart from the longitudinal axial lines A—A by the distance C. Further, all the mounting bosses 6 and 8 can be arranged in the same direction, and the upper end surface 6A and 8A and the lower end surface 6B and 8B of all the mounting bosses 6 and 8 can be arranged at the position apart from the longitudinal axial line A—A by the distance N.

Then, the fuel distribution pipe is assembled in the intake pipe or the throttle body in the following manner.

Figure 6:
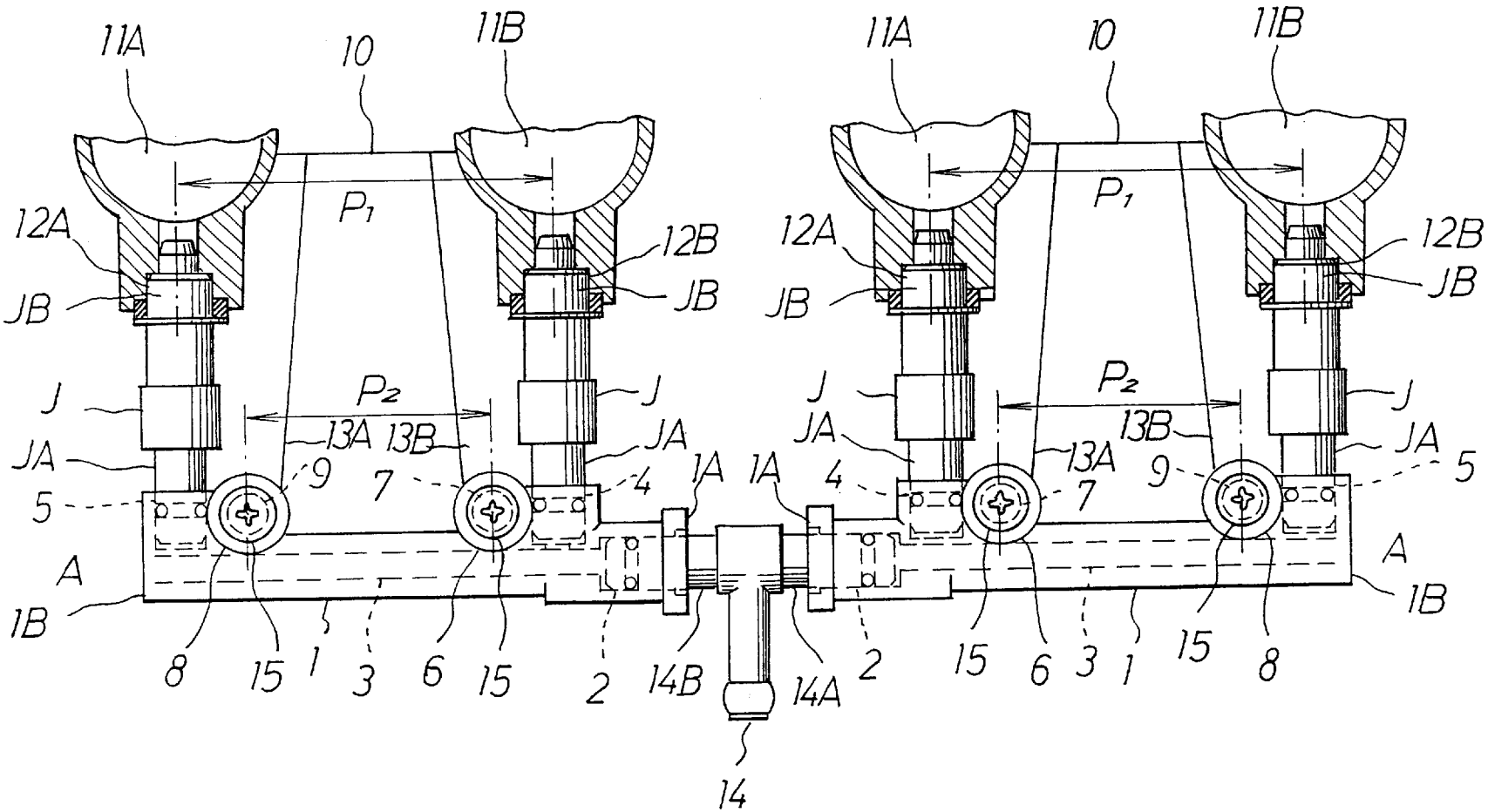
FIG. 6 is a plan view of an upper portion including a cross sectional view showing an assembled state in a throttle body.

The throttle body 10 is, as shown in FIG. 6, provided with two intake passages 11A and 11B, two injection valve leading end insertion holes 12A and 12B, and two fixing portions 13A and 13B.

Among them, two injection valve leading end insertion holes 12A and 12B are respectively opened in the same manner downward in FIG. 6, and a pitch P1 between the insertion holes is formed the same as an interval E between the injection valve insertion holes 4 and 5 of the fuel distribution pipe 1.

Further, two fixing portions 13A and 13B are formed at the same position along the back of the paper surface in FIG. 6, and the fixing portion 13A and 13B are particularly formed in a threaded hole. Further, a pitch P2 between the fixing portions 13A and 13B is formed the same as an interval H between the mounting holes 7 and 9 of the fuel distribution pipe 1.

Two throttle bodies 10 each having the structure mentioned above are arranged side by side, whereby a throttle bodies for a 4-cylinder engine is prepared.

Next, the fuel injection valves J are attached to two fuel distribution pipes 1 and 1, the rear ends JA of the fuel injection valves J are arranged so as to be inserted into four injection valve insertion holes 4, 5 and 4, 5, and a T-shaped fuel joint 14 is arranged so as to be inserted into the opposing fuel introduction holes 2 and 2. A first joint portion 14A of the fuel joint 14 is inserted into the right fuel introduction hole 2, a second joint portion 14B is inserted into the left fuel introduction hole 2, and a third joint portion 14C is open downward in FIG. 6.

Figure 7:
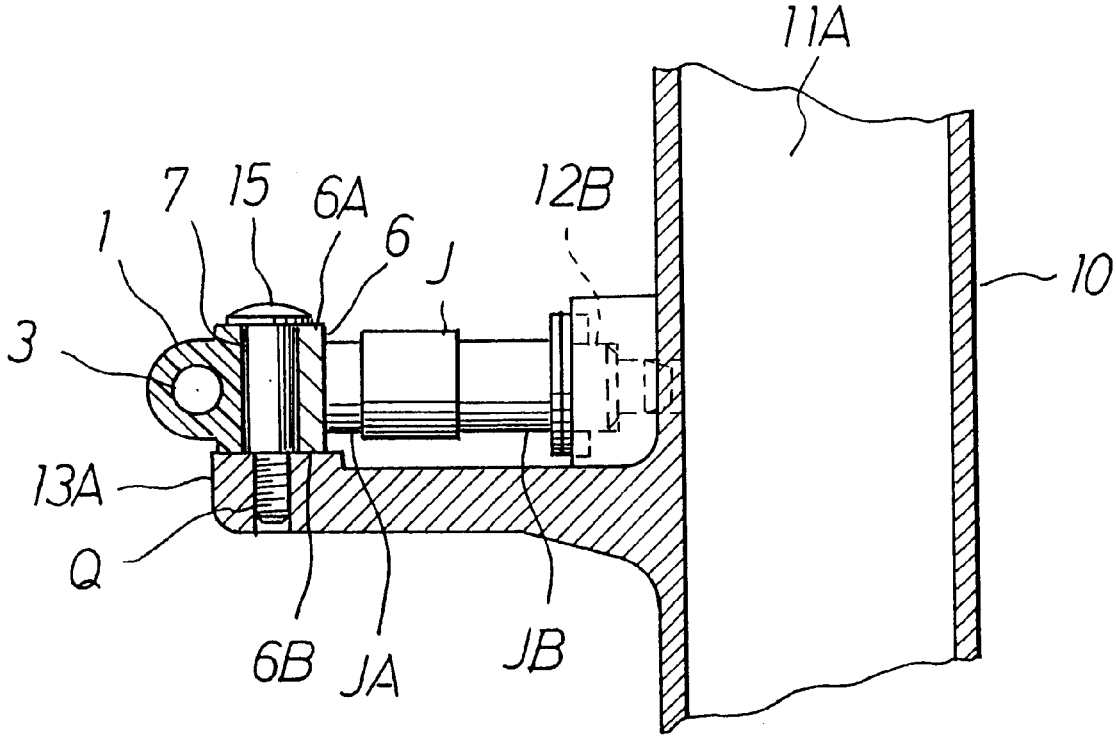
FIG. 7 is a vertical cross sectional view taken along a line R—R in FIG. 6.
Figure 8:
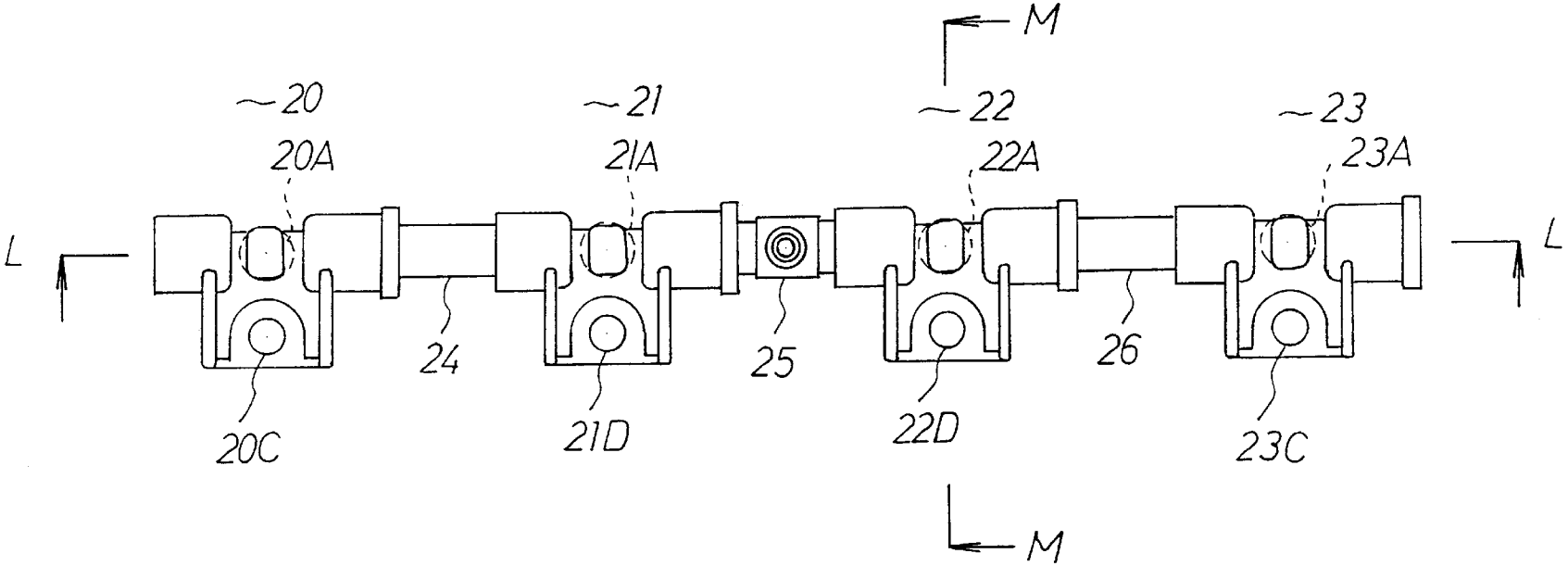
FIG. 8 is a plan view showing a conventional fuel distribution pipe.
Figure 9:
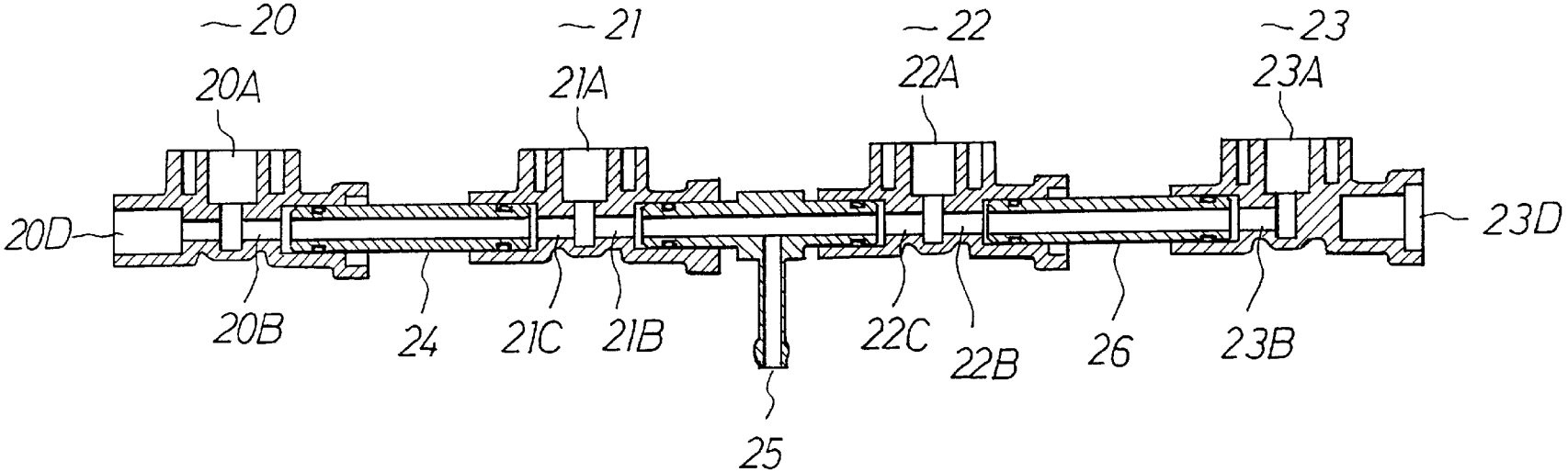
FIG. 9 is a transversal cross sectional view taken along a line L—L in FIG. 8.
Figure 10:
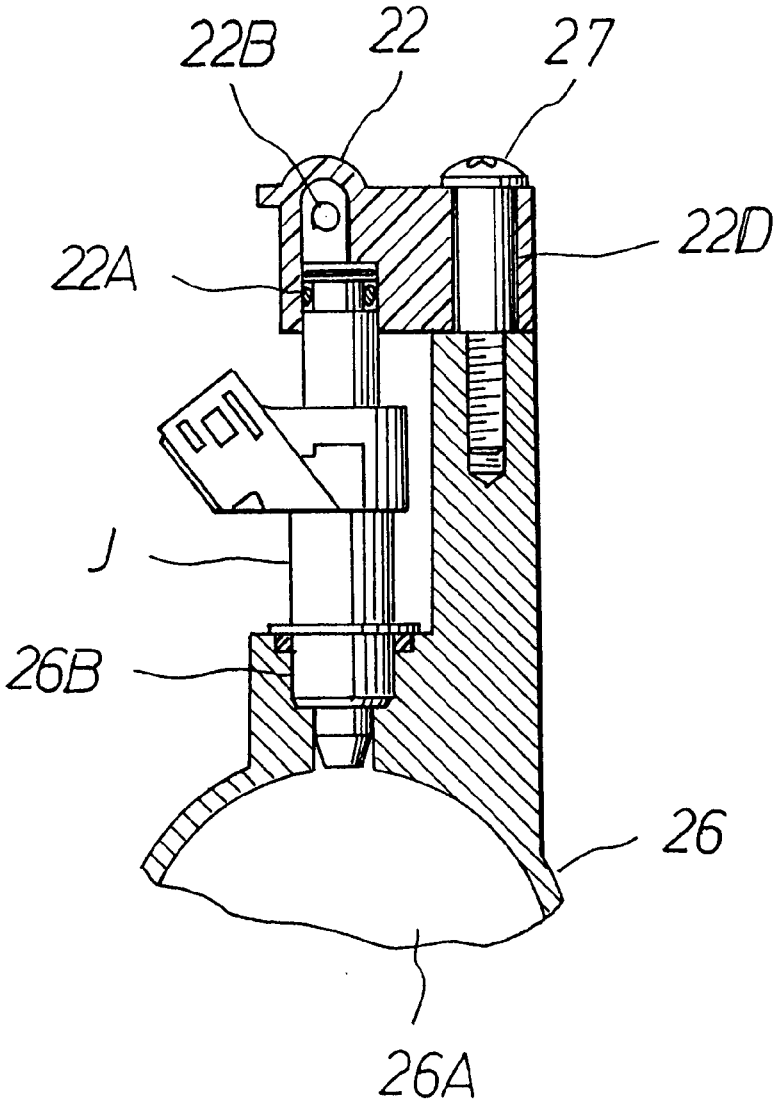
FIG. 10 is a vertical cross sectional view in a state in which a fuel injection valve is attached along a line M—M in FIG. 8.

Next, a leading end portion JB of the fuel injection valve J is arranged so as to be inserted into each of the injection valve leading end introduction holes 12A and 12B of the throttle bodies 10 and 10, and at this time, each of the mounting holes 7 and 9 of the fuel distribution pipe 1 is arranged to be opposed the threaded hole Q in each of the fixing portions 13A and 13B in the throttle bodies 10 and 10. In this state, a screw 15 is inserted into each of the mounting holes 7 and 9 and is engaged with the threaded hole Q. (This is well shown in FIG. 7.)

In accordance with the structure mentioned above, each of the fuel distribution pipes 1 and 1 are fixed to each of the throttle bodies 10 and 10, and the fuel injection valves J are held between the fuel distribution pipe 1 and the throttle body 10.

As described above, in accordance with the fuel distribution pipe on the basis of the present invention, the following structure can be obtained.

That is, the fuel distribution passage 3 is structured such that one end 1A is opened by the fuel introduction hole 2, another end 1B is closed, and the fuel distribution passage 3 is formed along the longitudinal direction.

The injection valve insertion holes 4 and 5 are positioned apart from the longitudinal axial line A—A of the fuel distribution passage 3 toward one side B by the distance C, have the longitudinal axial lines D—D thereof crossing orthogonally to the longitudinal axial line A—A, have the leading end open toward one side B and the rear end communicated with the fuel distribution passage 3, and are formed along the longitudinal axial line A—A with the interval E.

The mounting bosses 6 and 8 are formed orthogonally to the cross section including the longitudinal axial lines D—D of the injection valve insertion holes 4 and the longitudinal axial line A—A of the fuel distribution passage 3, and have the upper end surfaces 6A and 8A and the lower end surfaces 6B and 8B formed so as to uniformly protrude upward F and downward V on the basis of the longitudinal axial line A—A of the fuel distribution passage 3.

The mounting holes 7 and 9 are provided from the upper end surfaces 6A and 8A of the respective mounting bosses toward the lower end surface 6B and 8B, and provided apart from the longitudinal axial line A—A of the fuel distribution passage 3 toward one side B by the predetermined amount G.

Accordingly, one of the fuel distribution pipes 1 is reversed at 180 degrees so as to arrange the fuel introduction holes 2 to be opposed and concentrically arrange the longitudinal axial lines A—A of the fuel distribution passages, thereby arranging the fuel valve insertion holes 4 and 5 of each of the fuel distribution pipes 1 and 1, and the mounting bosses 6 and 8, and further the mounting holes 7 and 9 in the same direction at the same position. Therefore, it is possible to reduce the number of the fuel distribution pipes prepared as a multiple cylinder engine, and it is possible to reduce the number of the parts and the assembling man-hour.

Further, since it is possible to reduce the number of the fuel joints communicating the fuel distribution pipes, it is possible to reduce the number of the parts and the number of the assembling man-hour, and it is further possible to reduce the man-hour of the airtight test in the connection portion of the joints.

In this case, the present embodiment is described with respect to the 4-cylinder engine, however, it goes without saying that the present invention can be carried out in the multiple cylinder engine.

What is claimed is:

1. A fuel distribution pipe in a fuel injection apparatus, in which fuel having a pressure increased by a fuel pump is supplied to a fuel distribution passage and a plurality of fuel injection valves for injecting and supplying the fuel within said fuel distribution passage toward an engine are provided, wherein said fuel distribution pipe comprises:

a fuel distribution passage formed along the longitudinal direction with one end being opened by a fuel introduction hole and another end being closed;

a plurality of injection valve insertion holes positioned apart from the is longitudinal axial line of the fuel distribution passage toward one side by a predetermined amount, having the longitudinal axial lines of the injection valve insertion holes crossing orthogonally to said longitudinal axial line, having a leading end open toward one side and a rear end communicated with the fuel distribution passage, and formed along said longitudinal axial line with an interval;

a plurality of mounting bosses formed orthogonally to a cross section including the longitudinal axial lines of the injection valve insertion holes and the longitudinal axial line of the fuel distribution passage, and each having an upper end surface and a lower end surface being formed so as to uniformly protrude upward and downward by a predetermined amount on the basis of the longitudinal axial line of the fuel distribution passage; and mounting holes provided from the upper end surfaces of said respective mounting bosses toward the lower end surface, and provided apart from the longitudinal axial line of the distribution passage toward one side by a predetermined amount, wherein fuel introduction holes of said fuel distribution pipe are arranged so as to oppose to each other, the longitudinal axial lines of the respective fuel distribution pipes are concentrically arranged, the respective fuel injection valve insertion holes are arranged so as to open toward the same direction, said opposing fuel introduction holes are connected by a dingle fuel joint, rear end portions of the fuel injection valves are arranged so as to be inserted to the respective fuel injection valve insertion holes, and the fuel distribution pipe is screwed with and fixed to fixing portions by screw members inserted to the respective mounting holes.

* * * * *